United States Patent [19]

Clark et al.

[11] Patent Number: 4,827,095

[45] Date of Patent: May 2, 1989

[54] DIFFERENTIAL PRESSURE SWITCH ASSEMBLY WITH HIGH STATIC PRESSURE USE CHARACTERISTICS

[75] Inventors: Stephen S. Clark, Michigan City, Ind.; John M. Donnelly, Overland Park, Kans.

[73] Assignee: Dwyer Instruments, Inc., Michigan City, Ind.

[21] Appl. No.: 180,571

[22] Filed: Apr. 12, 1988

[51] Int. Cl.[4] ..... H01H 35/35

[52] U.S. Cl. ..... 200/83 J; 200/82 C; 200/835; 73/745

[58] Field of Search ..... 200/81 R, 82 R, 82 C, 200/81.4, 81.5, 83 A, 83 R, 83 S, 83 P, 83 SA, 83 J, 302; 307/118; 91/1; 92/5; 73/717, 723, 745; 340/611, 626

[56] References Cited

U.S. PATENT DOCUMENTS

| | | | |
|---|---|---|---|
| 2,803,718 | 8/1957 | Bloom | 200/82 C |
| 4,317,971 | 3/1982 | Roth | 200/82 C |
| 4,323,742 | 4/1982 | Priest | 200/82 C |
| 4,637,258 | 1/1987 | Priest | 73/716 |

*Primary Examiner*—Gerald P. Tolin

*Attorney, Agent, or Firm*—Mann, McWilliams, Zummer & Sweeney

[57] ABSTRACT

A differential pressure switch assembly that includes a conventional snap action switch for controlling the off-on modes of operation of state of the art equipment, which assembly comprises a high pressure plate that defines the high pressure cavity and a high pressure port of restricted size therefor, a low pressure plate that defines a first subchamber of the assembly low pressure cavity and a low pressure port therefor, a diaphragm clamped between the high and low pressure plates and separating the switch assembly high and low pressure cavities, a piston mounted in the low pressure plate for movement perpendicularly of the assembly diaphragm and biased toward the diaphragm by an adjustable range spring device, the range spring of which can be adjusted to provide the set point for the switch assembly, with the range spring device being formed to dispose the range spring in a second low pressure subchamber that is in open communication with the first low pressure subchamber to form a composite low pressure chamber, and with the low pressure plate journaling a rotary take out shaft that is coupled to the piston within the low pressure composite chamber and actuates a mechanical mechanism for utilizing the diaphragm motion for a particular set point of a switch assembly to actuate the snap action switch of same free of high deadband.

29 Claims, 5 Drawing Sheets

FIG. 1
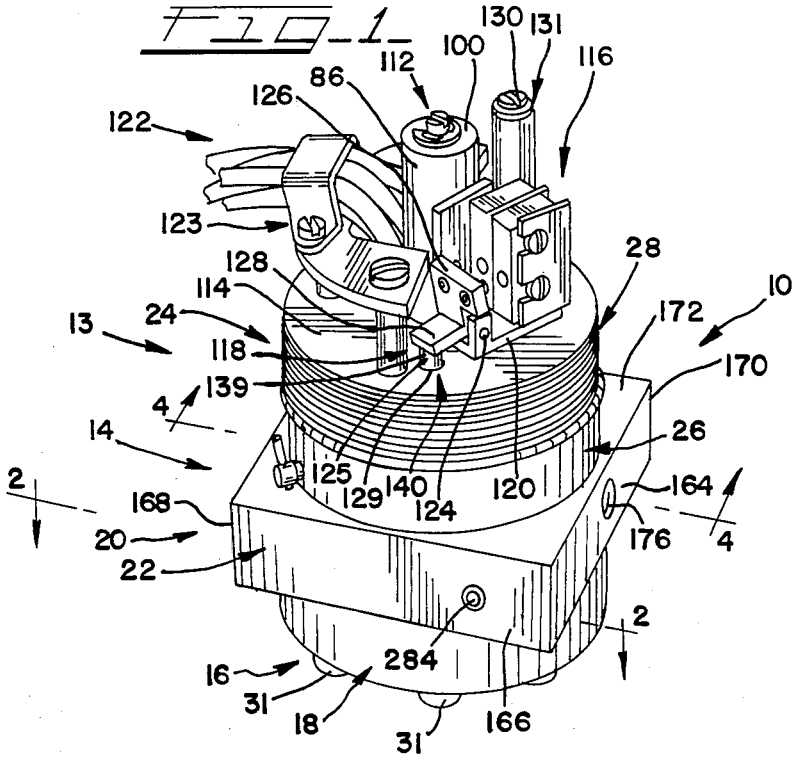
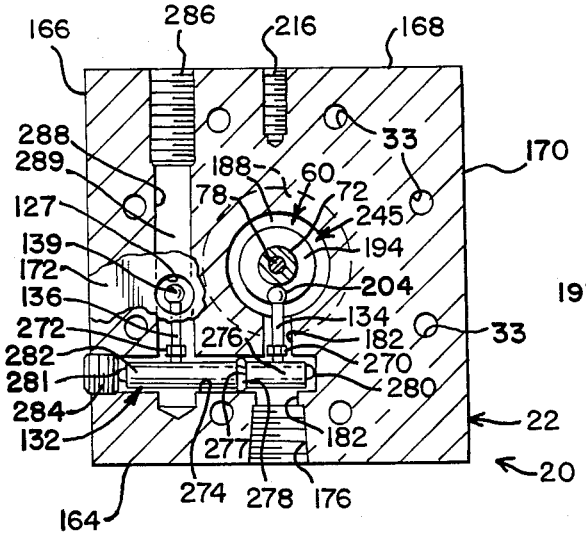
FIG. 3
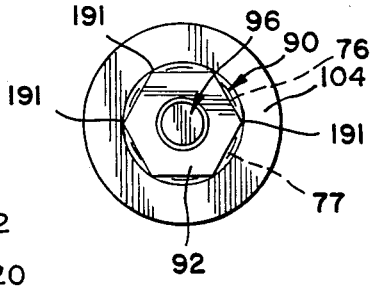
FIG. 2

DIFFERENTIAL PRESSURE SWITCH ASSEMBLY WITH HIGH STATIC PRESSURE USE CHARACTERISTICS

This invention relates to a diaphragm operated differential pressure switch assembly or unit, and more particularly, to a diaphragm operated differential pressure switch assembly or unit of the type employing a conventional snap action switch for effecting the desired off-on mode of operation of equipment controlled by the switch assembly involved (such as motors o fans), in which diaphragm motion that is effected by changes in differential pressure is employed to actuate the snap action switch, even though the high pressure chamber is fully sealed off from the lower pressure chamber within the switch assembly, the snap action switch of the assembly is located externally of and is sealed off from the switch assembly pressure chambers, the fluid involved may be either a liquid or a gas, and the fluid pressure to which both pressure chambers are exposed may be many times greater than the differential pressures to be sensed by the assembly.

Differential pressure switches as such are commonly employed to control the operation of snap action switches, such as the common microswitch made and sold by Micro Switch Division of Honeywell, of Freeport, Ill., to shift the snap action switch between off and on modes for actuating or deactuating equipment when a predetermined pressure differential is sensed. An example is disclosed in Phillips and Zoludow U.S. Pat. No. 3,566,060, granted Feb. 23, 1971 (and assigned to the same assignee as that of the present application).

A differential pressure switch is a device which utilizes differential fluid pressure from low and high pressure sources to actuate an electric switch at a pre-set actuation point. The pre-set actuation point may be the difference. between two positive or two negative pressures, one of each, or a positive and atmospheric, or a negative and atmospheric, pressure. The electric snap action switch employed is normally used to start or stop motors or fans, open or close dampers or louvers, energize an alarm or alarms, etc.

Differential pressure switch assemblies commonly define a pressure cavity across which is mounted a flexible diaphragm separating high and low pressure chambers, with the motion of the diaphragm due to changes in differential pressures between the fluid pressures in the respective high and low pressure chambers actuating a snap action switch mechanism, such as the familiar microswitch, that is part of the switch assembly. Thus, when a change occurs in the differential pressure between the two sides of the diaphragm of the basic switch assembly, (which is spring loaded by an adjustable range spring), the movable portion of the diaphragm shifts, transmitting a force to the assembly snap action switch. Such motion of the diaphragm is resisted by the assembly range spring, the spring action of which on the diaphragm is adjustable for setting of the actuation point of the snap action switch.

In this connection there are several switch terms in this art that have long established meanings that need to be kept in mind. For instance, the term "range" as used in this art is concerned with the span of differential pressures within which the differential pressure sensing mechanism involved can be said to actuate an electric switch. A "normally open switch" is a switch in which the contacts are normally open, with actuation closing the contacts, while a "normally closed switch" is a switch in which the contacts are normally closed, actuation opening said contacts. The snap action switch that has been referred to is preferably of the well known single-pole, double-throw snap action type, that is, a switch combining both normally open and normally closed switch contacts, of which the well known microswitch is an example.

Diaphragm operated differential pressure switches include, as indicated, an adjustable range spring arrangement opposing diaphragm motion, and it is this spring that determines the range of differential pressures within which a diaphragm motion will actuate the snap action switch. As is also indicated, the position of the diaphragm movable portion deflected by a predetermined pressure differential and acting against the range spring, can be adjusted by adjusting justing the spring action of the range spring employed, this principle of operation being employed to set the actuation point of the switch assembly involved.

While pressure differential gauges and switches, and in particular those of the diaphragm operated type, are well known to the art, it is also well known to the technical field involved that no one existing differential diaphragm operated pressure switch assembly is operable for both liquids and gases, and at total pressures that may greatly exceed the differential pressure actuation point (set point pressure) to which the switch assembly or unit has been set, as for instance, at total pressures that may be at magnitudes in the range of from about ten to about three thousand times the switch set point pressures.

A principal object of the present invention is to provide a diaphragm operated differential pressure switch assembly or unit that is usable with either liquid or gas (either of which may be neutral, poisonous, and/or inflammable), and which may involve high static pressures that greatly exceed the differential pressure range to be sensed by the switch assembly involved, with the switch assembly minimizing friction (and thus deadband) in operation and with a switch assembly or unit not requiring any change of set point with a change in the system operating pressure.

Another principal object of the present invention is to provide a diaphragm operated differential pressure switch assembly or unit that transmits the diaphragm motion resulting from a differential pressure change to the assembly snap action switch through a high pressure seal that physically separates the assembly high pressure and low pressure chambers of the switch assembly from the switch mechanism while being fully effective as a seal therebetween, so that the total pressure that the switch assembly is subjected to may be many times greater than the differential pressures to be sensed by the assembly.

Yet another principal object of the invention is to provide a diaphragm operated differential pressure switch assembly in which the diaphragm itself serves as the seal that separates the high and low pressure sides of the assembly, with the diaphragm also being arranged so that its movable portion maintains essentially a constant effective area thereacross, during the diaphragm full stroke of travel, and the diaphragm being preconvoluted to allow for friction free travel by way of "rolling" of the diaphragm convolution in response to differential pressure changes (instead of stretching or sliding).

Still another principal object of the invention is to provide a diaphragm operated differential pressure switch assembly or unit in which internal friction of operation is minimized, as by employing a mechanical mechanism that transmits the diaphragm movement resulting from differential pressure changes to the snap action switch employed that is arranged to minimize kinetic friction that may be occasioned by the resulting diaphragm deflection, to avoid adding to the normal deadband of the snap action switch employed.

Yet a further principal object of the invention is to provide a diaphragm operated differential pressure switch unit or assembly in which internal kinetic energy of operation is minimized by arranging the adjustable range spring so that it is mounted in a subchamber that forms a part of the low pressure chamber of the switch assembly involved, for friction free application of the spring force provided by applying same directly to the diaphragm, while permitting screw type set point adjustment of the range spring between predetermined minimums and predetermined maximums from externally of the differential pressure mechanism involved, with user overtorquing of the adjustment screw in either direction without damage also being provided for.

Still a further principal object of the invention is to provide a diaphragm operated differential pressure switch assembly in which the diaphragm fully seats in the event of overpressure in either the low pressure, or the high pressure (and thus reverse) directions, and to insure that the diaphragm does not extrude during reverse overpressure, and does not seal off the differential pressure assembly involved high pressure port during normal operation.

A further important object of the invention is to provide a diaphragm operated differential pressure switch assembly composed of few and simple parts, that is inexpensive of manufacture and assembly, that is easy to use, and that can be employed for switch control in a wide variety of applications and in connection with either liquids or gases.

In accordance with the present invention, the diaphragm operated differential pressure switch unit or assembly is of the type having an internal pressure cavity across which is mounted a flexible diaphragm separating high and low pressure chambers, and having a conventional snap action switch (for instance of the microswitch type) mounted externally of the assembly pressure cavities, with the motion of the diaphragm due to changes in the differential fluid pressures involved in the respective assembly chambers being employed to actuate the electrical snap action switch that is part of the assembly. The switch assembly or unit comprises a composite body that defines the assembly pressure cavity, with the conventional snap action electrical switch being mounted externally of the composite body. The switch assembly composite body comprises a first rigid member in the form of a plate defining the assembly high pressure chamber, as well as means for connecting a high pressure fluid source to same, a second rigid member in the form of a plate defining a first subchamber of the assembly low pressure chamber (that is actually a composite chamber), and means for connecting a low pressure fluid source to such first subchamber, with the assembly high pressure chamber and the assembly first low pressure subchamber being separated only by the assembly diaphragm, and with the first and second rigid plates having congruent marginal lands that are seated and held against the periphery of the diaphragm. The assembly high pressure chamber and the assembly first low pressure subchamber are centered on a first axis that extends perpendicularly of the diaphragm, and includes a piston mounted in the second rigid member first subchamber in substantially centered relation with said first axis, and for movement longitudinally of such first axis in a rectilinear manner, with such piston having opposed ends, one of which engages the diaphragm, and a range spring seated against the other end of the piston for adjustably biasing the piston along the indicated axis and against with the diaphragm.

A third rigid member in the form of a housing for the range spring is anchored to the second plate and is substantially centered on the indicated first axis, with the third rigid member defining a second low pressure subchamber in which the indicated range spring is received. The second rigid plate member is recessed about the piston to define a void space thereabout intermediate the ends of the piston, with the indicated second rigid plate member and the third rigid member recessing defining a composite low pressure chamber within the switch assembly body.

The assembly further includes a rock shaft, of comparatively small diameter crosswise thereof, journaled in the assembly second rigid plate member for rocking movement about a rocking axis that is spaced to one side of the indicated first axis and lies in a plane that is oriented relative to the indicated first axis and the piston to be substantially normally thereof. The indicated rock shaft has a first radial arm that is coupled to the piston for movement therewith, and that is exposed to the fluid pressure within the composite low pressure chamber. The rock shaft in question has a second radial arm paralleling the first radial arm and equal to its length, spaced longitudinally of the rock shaft from the first radial arm, and the assembly includes means for sealing the second radial arm from the fluid pressures of the indicated low pressure composite chamber; the assembly also includes mechanical means interposed between the rock shaft second arm and the snap action electrical switch for actuating the electrical switch when the differential pressure sensed by the switch assembly differential pressure chambers reaches a predetermined amount, as determined by the set point on the switch assembly involved.

The rigid third member that houses the range spring, and in particular the subchamber or recess of same that houses the range spring, is sealed against fluid under pressure in the composite low pressure chamber, and is in open communication with the second rigid member first subchamber, as indicated, the conventional snap action electrical switch is mounted externally of the switch assembly high and low pressure chambers so as to be otherwise unaffected by the fluid pressures in such chambers.

As has been also indicated, the switch assembly diaphragm is arranged so that its movable portion maintains a substantially constant "effective area" across the midportion of same that is also to seal the high fluid pressure chamber from the composite low pressure chamber. During the full stroke of travel of the diaphragm a rolling action of the diaphragm occurs, it being preconvoluted for this purpose, so that it does not stretch or slide in response to changes in differential pressure.

Further, the diaphragm and associated first and second rigid members are arranged so that the diaphragm will fully seat if overpressurized in either direction. The high pressure chamber is indented away from the diaphragm to define a chamber portion that spaces the diaphragm from the bottom of the high pressure chamber, and the piston cooperates with a diaphragm plate that is fitted into the second rigid member and defines an indentation on which the piston is centered that is also indented away from the diaphragm. Both the assembly first rigid plate and the assembly diaphragm plate define annular lands that engage either side of the diaphragm in congruent relation about the diaphragm constant "effective area". In the case of the high pressure chamber this avoids extrusion of the diaphragm during low pressure chamber overpressure. The piston is constrained in movement so that the diaphragm does not seal off the high pressure port during normal operation, but on high overpressure in reverse the diaphragm can seal off the high pressure port (once the overpressure involved is removed, the sealing is removed). The arrangement of annular lands and the high and low pressure chamber geometry prevents blowout at the diaphragm convolution and flat surfacing. The indicated indenting of the low pressure diaphragm plate is in proportion to the diaphragm preconvoluting and insures full seating of the diaphragm convolution against the diaphragm plate should overpressurization occur in the assembly high pressure chamber.

Further, the first and second rigid plate members of the body are each formed with an annular groove about their respective lands that are coaxially and congruently oriented; in each such groove an O-ring seal is mounted in sealing relation to the diaphragm on either side thereof to prevent fabric/elastomer separation of the diaphragm components, and differential pressure cavity blow out at high pressures.

The switch assembly involved includes a fourth rigid member of the body that is received about and in close fitting relation to the body third rigid member, and defines an aperture centered on the indicated first axis in which the body third rigid member is received, with the body third rigid member adjacent the body second rigid member defining a flange about same, and the body fourth rigid member being seated against the body third rigid member flange and secured to the body first rigid member through the body second rigid member by suitable threaded means such as bolts or the like. The switch assembly involved includes a fluid seal of the O-ring type between the body third rigid member flange and the body second rigid member.

The switch assembly range spring is of the helical type, with the body third rigid member subchamber defining recess having a portion of same of non-circular configuration (hex shaped in the disclosed embodiment) through which the range spring extends, with screw and nut means being provided for setting the assembly range spring to provide a desired set point for action of the snap action switch, including a nut of non-circular configuration that is received in close fitting sliding relation with and within the body third rigid member recess and also said first axis, with such nut being threadedly received on a screw shank seated in the body third rigid member, which shank has a head that projects externally of the body third rigid member and is slotted at its exposed end for rotation of same for adjusting the range spring to vary the set point of the switch assembly involved.

In the disclosed embodiment, the snap action switch of the switch assembly is mounted on the body fourth member adjacent the third member receiving aperture of same, and the assembly includes a bell crank member mounted on the fourth member adjacent to and in operative relation to the assembly snap action switch, with a thrust rod extending between the rock arm second radial arm and the bell crank lever for actuating the snap action switch in accordance with the motion of the switch assembly diaphragm as determined by the set point to which the range spring has been set for the particular switch assembly involved.

The switch assembly may be completed by a housing affixed to the switch assembly body and enclosing the snap action electrical switch, the bell crank for actuating the snap action switch, and the portion of the thrust rod that actuates the indicated bell crank, with such housing also enclosing the electrical wiring for the switch as well as defining a fitting through which such wiring may be extended for connecting the switch to what is to be controlled by the switch assembly in question.

It is a feature of the present invention that not only is the diameter of the rock shaft and the seal of same that is intermediate such radial arms kept small, but the rock shaft radial arms that are of equal length radially of such rock shaft and are disposed in coplanar relation. Preferably the rock shaft has a diameter that is less than 0.2 inch in length; travel of the diaphragm "effective area" is preferably less than 0.020 inch, the friction elimination that is achieved by the rolling action of the diaphragm, the small radial diameter of the rock shaft, the arrangement of the rock shaft radial arms, the minimal travel of the diaphragm "effective area" involving differential pressure changes to actuate assembly the snap action switch, and the elimination of substantially all of the sliding friction at the rock shaft seal during actuation of the diaphragm, eliminates substantially all kinetic friction in the operation of the switch assembly of the invention and results in the torque that is applied to the rotary shaft being substantially that needed to operate the switch assembly snap action switch.

The switch assembly housing is arranged to be explosion-proof and waterproof. The housing involves a draining arrangement which will allow inflammable fluid to drain from the housing before reaching the electrical snap switch mechanism, and involves a threaded drain plug at the exterior of the drain that is in a loose fitting relation for better draining purposes without impeding draining. This arrangement also insures that undesirable pressure build ups will not occur within the switch assembly housing.

Other objects, uses, and advantages will be obvious or become apparent from a consideration of the following detailed description and the application drawings in which like reference numerals indicate like parts throughout the several views.

In the drawings:

FIG. 1 is an external diagrammatic perspective view of a differential pressure switch assembly arranged in accordance with the present invention, with the housing for the snap action electrical switch component of same being totally omitted (but see FIG. 4), and the electrical wiring involved being shown only fragmentally illustrated;

FIG. 2 is a fragmental cross-sectional view taken substantially along line 2—2 of FIG. 1 illustrating several important details of the switch;

Figure 4:
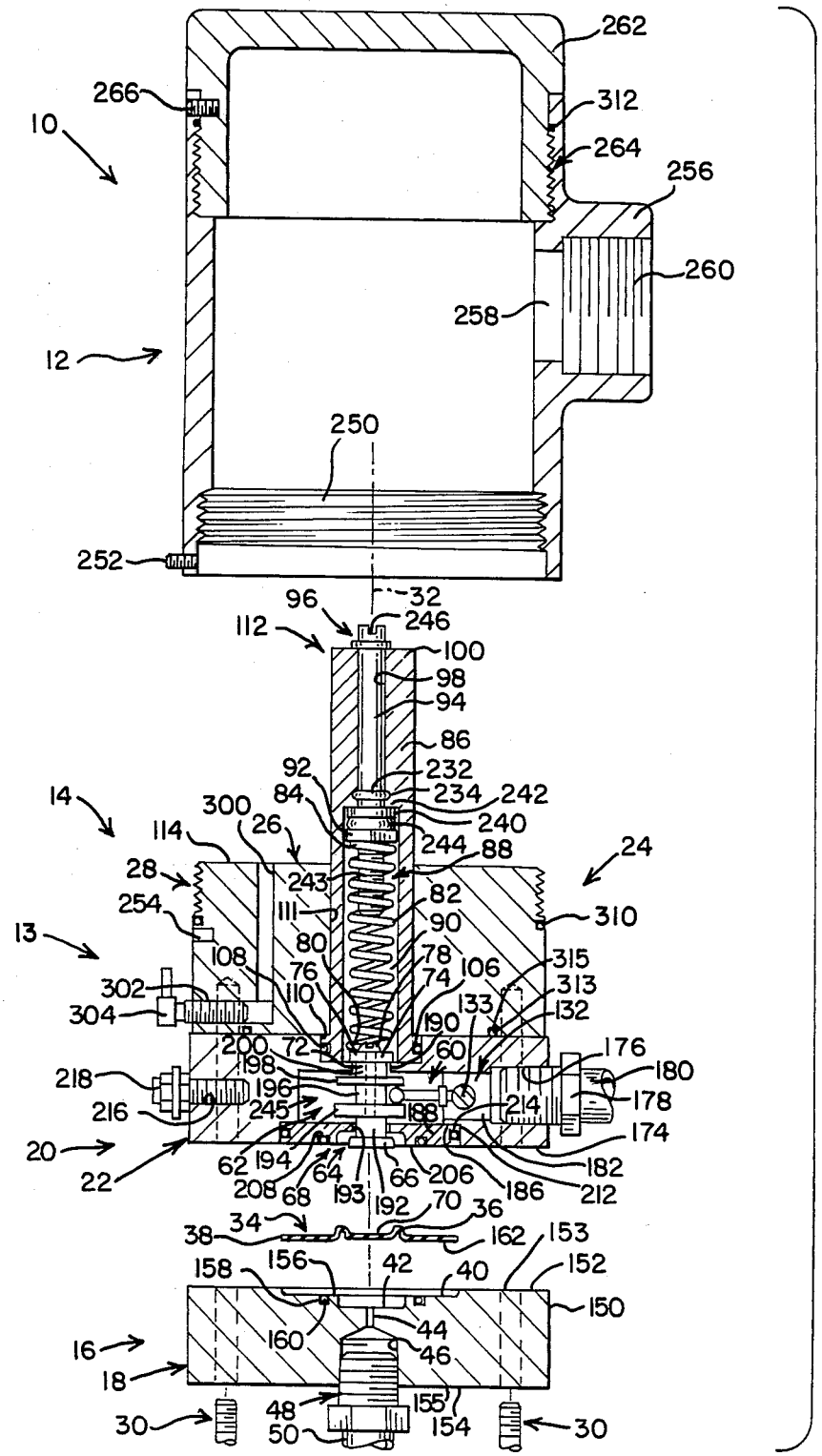
Figure 5:
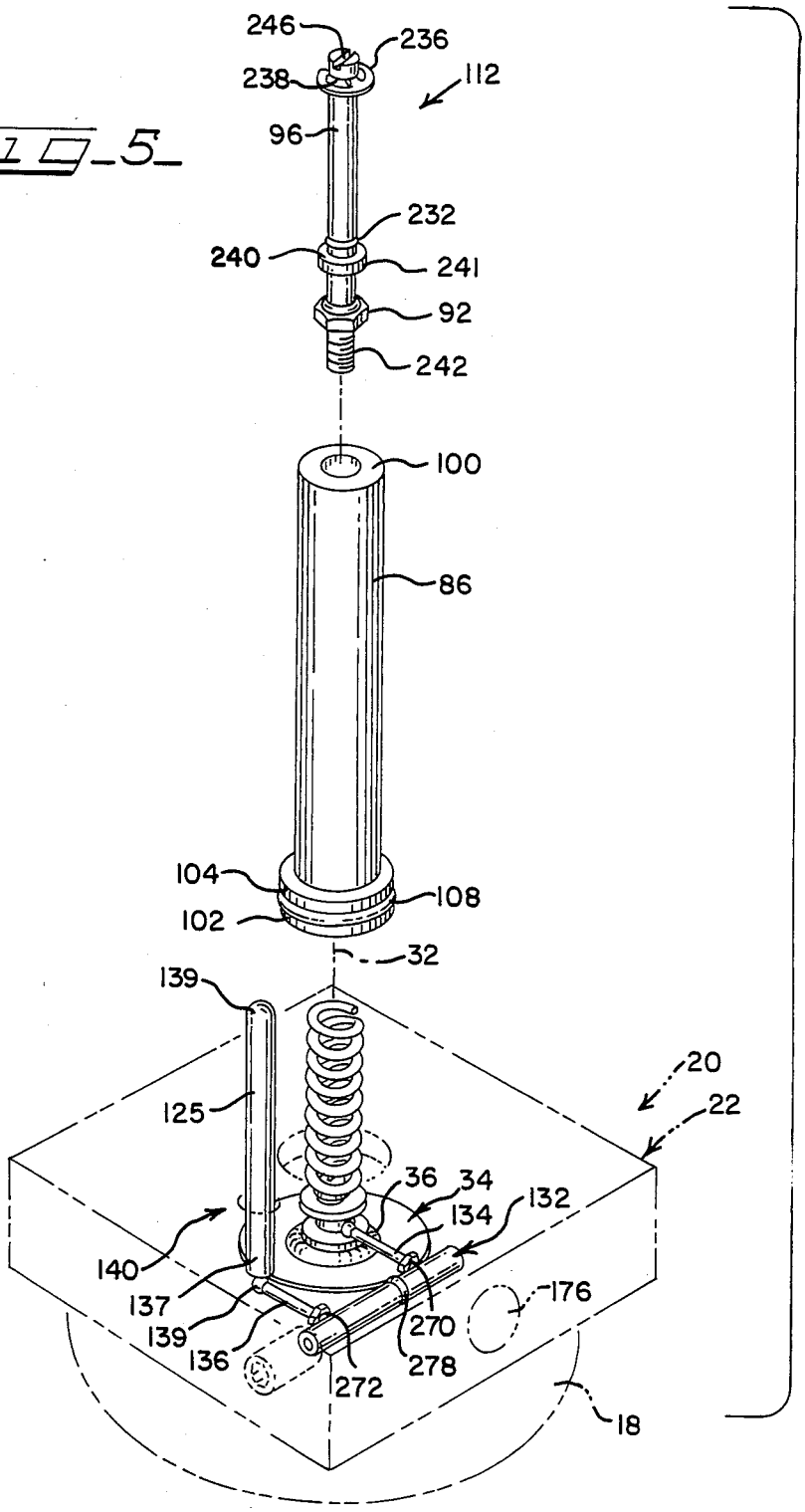
Figure 6:
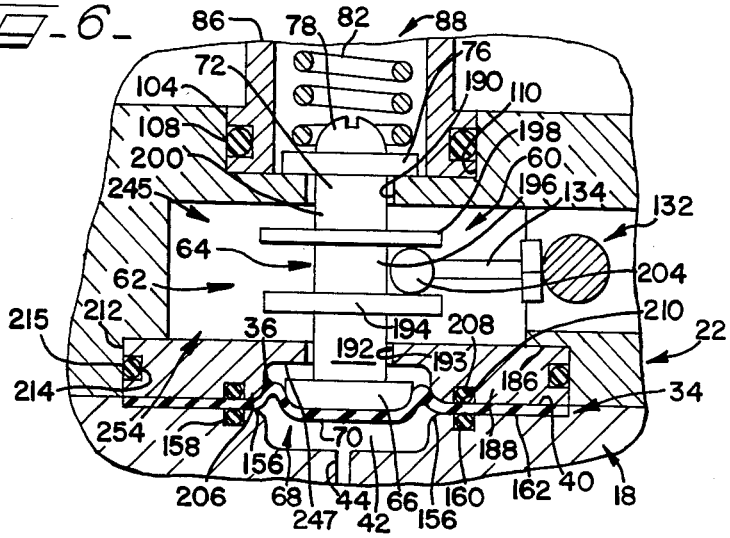
Figure 7:
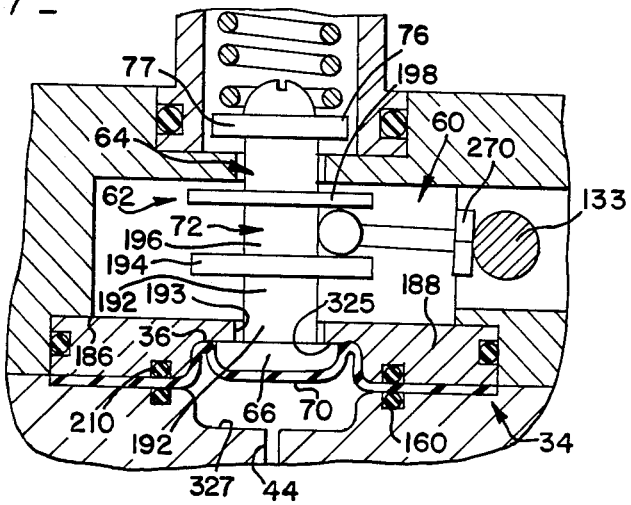
Figure 8:
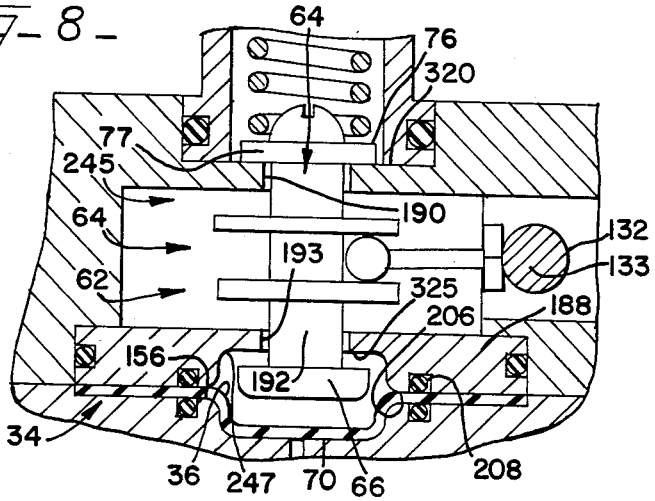
Figure 9:
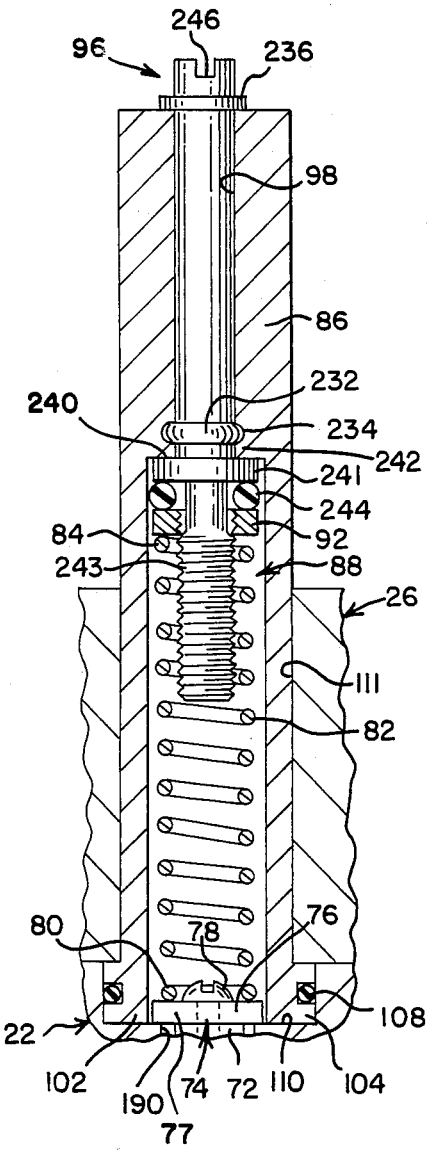
Figure 10:
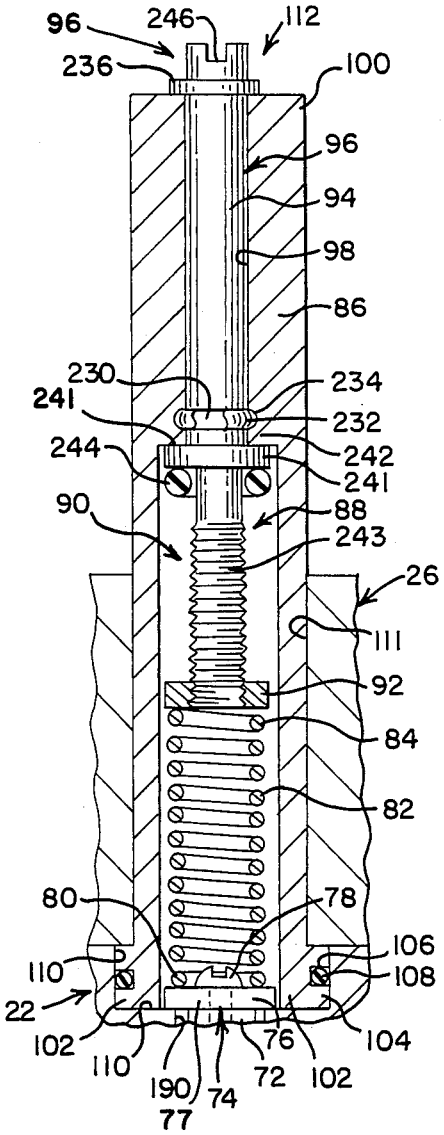

FIG. 3 is an inner end elevational view of the range spring housing (that is shown in section in FIG. 4), better illustrating the portion of the range spring housing subchamber that is of hex shaped transverse cross-sectional configuration for mounting the range spring adjustment nut for sliding movement longitudinally of the range spring housing when the set point of the switch assembly is adjusted and showing also the manner in which the range spring housing subchamber is fluid flow connected to the low pressure plate subchamber for forming the assembly composite low pressure chamber;

FIG. 4 is a diagrammatic exploded longitudinal sectional view through the differential pressure switch assembly shown in FIG. 1, but including the switch assembly housing, with the view of FIG. 4 being taken substantially along line 4—4 of FIG. 1, and omitting the conventional snap actuation electrical switch, the bell crank actuation therefor including its mounting, and the other conventional components that are shown in the diagrammatically illustrated FIG. 1;

FIG. 5 is a diagrammatic exploded sectional view illustrating the major components of the switch assembly, with the switch assembly housing omitted, and the switch assembly body partially illustrated in broken lines;

FIG. 6 is an enlarged view of the differential switch assembly diaphragm and associated parts showing the diaphragm and piston in a position of normal operation wherein the pressure differential involved is below the set point pressure;

FIG. 7 is a view similar to that of FIG. 6, but shows the diaphragm and piston seating relation in the event of overpressure on the high pressure side of the switch assembly;

FIG. 8 is a view similar to that of FIG. 6, but illustrating the diaphragm and piston seating relation in the event of reverse overpressure, that is overpressure on the low pressure side of the switch assembly;

FIG. 9 is an enlarged longitudinal sectional view of the differential pressure switch assembly range spring, its housing, and the screw and nut type adjustment device for adjusting the set point of the differential pressure switch assembly involved, showing the range spring overtightened in the decreasing set point direction; and FIG. 10 is a view similar to that of FIG. 9, but showing the range spring overtightened in the increasing set point direction.

However, it should be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 10 of FIGS. 1 and 4 generally indicates one embodiment of a differential pressure switch assembly arranged in accordance with the present invention, with the housing 12 for the switch assembly snap action electrical switch and wiring therefor that is shown in longitudinal section in FIG. 4 being omitted from the showing of FIG. 1.

The switch assembly 10 generally comprises in addition to the housing 12 a differential pressure sensing mechanism 13 including body 14 comprising a high pressure member or segment 16 in the form of a round plate 18, a low pressure member or segment 20 in the form of plate 22 that is of quadrilateral marginal configuration, and an anchor member or segment 24 in the form of a round plate 26 that is nominally of the same external diameter as plate 18. Plate 26 is externally threaded as at 28 to threadedly receive housing 12 (see FIG. 4), as will be made clear hereinafter.

The high pressure plate 18 is secured to the anchor plate 26 by a plurality of suitable bolts 30 (see FIG. 4) that are applied through suitable bolt holes 33 formed in the plates 18, 22 and 26, with the bolt holes of plate 26 being suitably internally threaded so that the bolts 30 (the heads 31 of which are fragmentally shown in FIG. 1) securely clamp the plates 18 and 22 together and against the anchor plate 26. This securing arrangement in and of itself may be of any suitable conventional type, and thus is largely omitted for that reason.

In a successful embodiment eight such bolts 30 are employed to clamp plates 18 and 22 together and against anchor plate 26, with the holes for the individual bolts 30 being equally spaced apart in a circular array that is coaxial with the center or longitudinal axis 32 of the body 14.

Clamped between the plates 18 and 22 is a flexible diaphragm 34 (that is preconvoluted to define annular convolution 36). The diaphragm 34 (see FIG. 4) has a circular periphery 38, and is received in a circular indentation 40 of the plate 18 above a high pressure cavity 42 formed in plate 18. The plate 18 is also formed with an internal passage or orifice 44 of a relatively small diameter of no more than about 0.0135 inch that serves as a high pressure port for the high pressure cavity 42 leading from internally threaded opening 46 of frustoconical configuration providing access to the high pressure cavity 42 from a suitable high pressure source. In the showing of FIG. 4, suitable conventional fitting 48 is threadedly applied to opening 46 as a conventional means of connecting conventional tubing 50 that connects the high pressure source to orifice 44.

The low pressure plate 22 is internally recessed as at 60 to define a subchamber 62 in which piston 64 is reciprocably mounted. The piston 64 includes a head 66 at its head end 68 that is to be biased into engagement with the central planar portion 70 of the diaphragm 34 that lies within the convolution 36. The piston 64 includes a stem 72, with the other end 74 of the piston 64 being formed by an annular spring seat 76 secured in place by suitable screw 78, in the illustrated embodiment (see FIGS. 4 and 6–10).

Bearing against the piston end 74 (and on spring seat 76) is the end 80 of compression type range spring 82, the other end 84 of which is shifted longitudinally of the axis 32 to adjust the bias that is applied by the piston to the diaphragm 34, and thus the "set point" of the switch assembly 10.

The helical range spring 82 is housed in cylindrical rigid housing member 86 that defines a subchamber 88 in which the range spring 82 is received and operates, as well as the end 74 of the piston 64. The subchamber 88 of member 86 includes an elongate portion 90 of suitable non-circular transverse cross-sectional configuration, such as a hex shaped configuration, that is configured to slidably but closely receive suitable conventional nut 92 (that is hex shaped in the illustrated embodiment since subchamber portion 90 is to be a slip fit configuration compatible to that of nut 92). Nut 92 is threadedly mounted on screw shank 94 of adjustment screw 96 that is rotatably mounted in a circular bore 98 that is coaxial with the range spring housing member 86 and extends between the subchamber 88 and the free end 100 of the range spring housing member 86, the other end 102 of same being flanged thereabout, as at 104, which flanging is formed to define marginal groove 106 (see FIG. 4), in which a suitable O-ring seal 108 is mounted. The plate 22 is counterbored as at 110 to receive the flanged end 102 of the range spring housing member 86, as shown in FIGS. 4, 9 and 10, and made clear hereinafter.

The anchor plate 26 is formed with bore or aperture 111 that is coaxial of body 14 and axis 32 and receives the range spring housing member 86 for clamping the housing flange 104 within plate 22 counterbore 110 when the switch assembly is assembled. O-ring seal 108 also seals off bore or aperture 111 which should be proportioned for close fitting relation with housing member flange 104.

The adjustment screw 96 and nut 92 comprise an adjustment device 112 for adjusting the spring action of the range spring 82 on piston 64, that in turn provides the set point or actuation point of the switch assembly 10, as more completely disclosed hereinafter.

Suitably mounted on the planar end surface 114 of anchor plate 26 are a conventional snap action electrical switch 116 and a bell crank 118 (see FIG. 1) for actuating same, both of which are conventional in nature, and which are suitably applied to a conventional mounting frame 120. The electrical switch 116 may be in the form of the microswitch made and sold by Micro Switch Division of Honeywell, of Freeport, Ill. and is suitably secured to the frame 120 in any conventional manner, as by employing screws or the like. The switch 116 is equipped with the usual three terminals in order to enable it to be electrically connected, using the usual electrical conduiting that is diagrammatically and fragmentally illustrated at 122 in FIG. 1, so as to be normally in open position or normally in closed position, at the installer's option. The mounting frame 120 is secured to anchor plate 24 in any suitable manner, as by employing mounting screws, and the bell crank 118 is pivotally connected to frame 120 as by pin 124, and includes the usual switch actuation arm 126 and the usual motion transmitting arm 128 that is disposed substantially at right angles to the arm 126, that is part of the mechanical motion transmitting mechanism employed by switch assembly 10 for actuating switch 116 based on movement of the diaphragm central portion 70 that reaches the switch assembly set point to which the switch assembly 10 has been set by the installer suitably adjusting the spring action of range spring 82 acting on the diaphragm through the piston 64, as by using adjusting device 112.

The wiring 122 as illustrated in FIG. 1 includes suitable holding bracketing of any conventional type that is diagrammatically illustrated at 123. The plates 18, 22, and 26 forming body 14 are formed from stainless steel or the like rigid material; body 14 may be suitably grounded, and for this purpose, a grounding post 131 is suitably mounted on the body 14 and includes a suitable attachment screw 130 for application thereto of a suitable grounding wire, at the installer's option.

The actuation of the bell crank 118 is effected by a thrust rod or post 125 that is reciprocably mounted in the plates 22 and 26, with the plates 22 and 26 being suitable bored or apertured for this purpose, as at 127 and 129, respectively (see FIGS. 1 and 2). The switch assembly 10 of the present invention is arranged to move the thrust rod 125 in proportion to the indicated movement of the diaphragm central portion 70 and thus piston 64, as the pressure differential sensed by the switch assembly 10 increases to the set point to which a particular assembly 10 has been set, for purposes of actuating the indicated snap action switch 116. For this purpose, the low pressure plate 22 has journaled in same a rock shaft 132 equipped with a pair of radial arms 134 and 136, with the arm 134 being coupled to the piston 64 for movement therewith and the arm 136 engaging the end 137 of thrust rod 125. The other end 139 of thrust rod 125 engages the actuation arm 128 of bell crank 118 (see FIGS. 1 and 5). Rock shaft 132 swings a limited amount about rock axis 133 (see FIG. 4) that lies in the plane of plate 22.

It will thus be seen that the piston 64, rock shaft 132 and its radial arms 134 and 136, thrust rod 125, and bell crank arm 118, form a mechanical linkage 140 (see FIG. 5) for communicating the motion of the diaphragm central portion 70 in responding to increases in differential pressure sensed by the mechanism 10, so as to ultimately position the bell crank 118 for actuating snap action switch 116 at the set point to which the switch assembly 10 has been set by the installer (or later reset as needed).

SPECIFIC DESCRIPTION

Referring now more specifically to the arrangement of the high and low pressure plates 18 and 22, the plate 18 is of cylindrical configuration, having cylindrical marginal wall 150 and planar ends 152 and 154 forming planar end surfaces 153 and 155, respectively (see FIG. 4). The fitting mounting internally threaded opening 46 of plate 18 extends from the planar end 154, while the indentation 40 for the diaphragm 34 is formed in end 152. The high pressure plate 18 also includes annular land 156 about which is formed circular groove 158 in which is seated O-ring seal 160 that is in sealing arrangement with the underside 162 of the diaphragm 34 in the assembled relation of the device (see FIGS. 6, 7 and 8).

The low pressure plate 22 in the form illustrated is of quadrilateral configuration (square in the illustrated embodiment), defining planar side edges 164, 166, 168, and 170, and planar end surfaces 172 and 174 that are in parallelism and that, in the assembled relation of the assembly 10, extend normally of the axis 32. In the form shown, high pressure plate 18 has a diameter that approximates the length of one of the indicated side edges of low pressure plate 22.

Plate 22 is formed with threaded opening 176 that is suitably internally threaded for application thereto of suitable fitting 178 that is conventional in nature and is to be operably connected to conduiting 180 (see FIG. 4) that extends to the source of low pressure to be sensed by assembly 10. Opening 176 is open to subchamber 62 (defined by plate 22, by way of suitable bore 182 (see FIG. 2) across which rock shaft 132 extends, as indicated in FIGS. 2 and 4, with the arm 134 being disposed in the subchamber 62 to which the piston 64 is also exposed. The range spring subchamber 88 is directly connected with subchamber 62, as by forming in the plate 22 an aperture 190 (see FIG. 6) in which the piston shank 72 is disposed centrally thereof, with the aperture 190 being sufficiently larger than the piston shank 72 in internal diameter to connect the subchamber 90 with the subchamber 60, and being sufficiently small in internal diameter so that the margin of the portion of plate 22 defining aperture 190 serves as a stop for piston 64. The spring seat 76 being circular in shape and being proportioned to readily fit within the range spring housing subchamber 88, the transverse hex shape of chamber 88 (see FIG. 3) as compared to the circular shape of spring seat 76 allows adequate fluid passage connection of a constant nature between subchambers 60 and 88, as at the corners 191 (of portion 90 of subchamber 88, with the outline of the outer sidewall 77 of spring seat 76 being indicated in FIG. 3).

Plate 22 is counterbored as at 186 to receive in close fitting relation thereto a piston stop plate 188 that is formed to be coaxial with axis 32 (in the assembled relation of assembly 10) and also defines coaxial aperture 193 which reciprocably receives piston stem 72. This disposing of piston 64, of course, is done during the assembly procedure, the piston stem 72 being cylindrically shouldered as at 192 for close fitting relationships within aperture 193; the piston 64 further comprises relatively thick washer 194 seated against the piston stem shoulder 192, a short tube 196, on which is seated a relatively thin washer 198. Seated against the washer 198 is short tube 200, with screw 78 being threaded into piston head 66 to hold spring seat 76 against the tube 200, and to hold the washers 194 and 198 against tube 196 and the balled end 204 of the radial arm 134 of rock shaft 132 to couple the rock shaft 132 to the piston 64 to rock the rock shaft 132. The piston stem 72 is thus defined by shoulder 192, and tubes 196 200, and the intervening portions of washer 194 and 198. The spring seat 76 receives the lower end of the range spring 82 and, as already indicated, is circular in configuration so as to fit inside the subchamber 88 of the range spring housing 86, whereby any low pressure fluids communicating with subchamber 60 also communicate with the subchamber 88 in which the range spring is housed, whereby a composite low pressure chamber 254 is formed.

It will also be seen that the head 66 of piston 64 forms an ultimate stop against plate 188 in the direction toward subchamber 88 (see FIG. 7), in an indentation 247 formed in plate 188 for this purpose, while the spring seat 76 forms an ultimate step for the piston 64 in the opposite direction, that is in the direction of the high pressure chamber 42 (see FIG. 8) Thus, the stop arrangement illustrated in FIG. 7 occurs in the event of overpressure on the high pressure side of assembly 10, while the stop arrangement illustrated in FIG. 8 occurs in the event of overpressure on the low pressure side of assembly 10.

The plate 188 also defines annular land 206 that opposes the land 156, with the plate being formed with annular groove 208 thereabout which receives O-ring 210 that is in sealing relation with the diaphragm 34 about the latter's convolution 36, and is disposed in opposition to O-ring 160. Plate 188 at its cylindrical margin 212 is formed thereabout with circular groove 214 having disposed therein O-ring seal 215, which is in sealing relation with the plate 22 at the counterbore 186.

Plate 22 also is formed to define internally threaded hole 216 (see FIG. 4) in which a conventional grounding screw 218 is threaded for applying a grounding wire to the body 14 in any suitable conventional manner.

Referring more specifically now to the range spring adjustment device 112, the shank 94 of screw 96 (see FIGS. 4, 5, 9, and 10) is suitably angularly recessed as at 230 to receive suitable O-ring spring 232 that is also fluid sealingly received in and about spring housing bore 98 in which the screw 96 is journaled, these parts being in close fitting relation, with the screw 96 freely rotatable within the housing opening 98. A conventional lock ring 236 received in annular groove 238 of the screw 96 anchors screw 96 against movement longitudinally of the housing 86, but with free rotation of the screw 96 being permitted about the housing opening or bore 98, and thus axis 32, when the device 10 is assembled. Screw 96 also includes a circular flange 240 (having a round rim 241) that is seated against the internal annular shoulder 242 (see FIG. 4) of the housing 86 to prevent dislodgement of the screw 96 from the housing 86 longitudinally of the axis 32 under any pressures developing within low pressure subchamber 88.

Referring now more specifically to FIGS. 9 and 10, the threaded portion 243 of the screw shank 94 projects within the housing 86 toward the high pressure cavity 42, with the nut 92 normally engaging the threading of screw shank portion 243. Interposed between the nut 92 and the screw flange 240 is O-ring 244 that has the purpose of serving as a compression spring on the nut 92 in the event that the screw 96 is overtorqued at minimum adjustment with the nut 92 running off the threading of threaded shank portion 243.

As is conventional, the screw 96 is provided with the usual screw driver receiving slot 246, exteriorly of the housing 86, and the threading of screw threaded portion 243 is of the familiar left hand configuration so that clockwise rotation of the screw 96 increases the set point of the assembly 10. Should the range spring device 112 be overtorqued at maximum adjustment, at which position the nut 92 has left the threading at the inner end of the shank 243, the range spring 82 will bias the nut 92 so that when the screw 96 is turned in a counterclockwise direction to decrease the set point, the nut 92 automatically threadedly engages the screw shank threaded portion 243.

As will be seen, the O-ring seal 232 of bore 98 is provided to insure the integrity of the composite low pressure chamber 245 defined by the subchambers 62 and 88. Flange 240 prevents blow out of the screw 96 from housing 86 should high static pressures be experienced in the composite low pressure chamber 245.

Referring now to the anchor plate 26, it, of course, is formed with the threaded bolt holes 33 that threadedly receive the respective bolts 30, as well as the central elongated aperture 111 that closely receives the range spring housing 86 and is coaxial therewith and with axis 32 in the assembled relation of the assembly 10. Anchor plate 26 is externally threaded as at 28 for threaded engagement with the internal threading 250 of the housing 12 (see FIG. 4). Suitable set screw 252 turned to be received in aperture 254 fixes the housing 12 against rotation relative to the body 14. The specific housing 12 that is illustrated (see FIG. 4) is provided with a suitable fitting 256 that is apertured as at 258 and internally threaded as at 260 for application thereto of suitable conduiting of a conventional nature that the wiring controlled by the snap action switch 116 controls is lodged in. Housing 12 is formed with a suitable cap 262 that is suitably threadedly connected to the housing 12 where indicated at 264, with suitable set screw 266 anchoring the cap 262 to the housing 12 in the assembled relation of the device. Removal of the cap 262 or the housing 12 (as a whole) exposes screw 96 for changing of the assembly set point by use of a conventional screw driver, if so desired, and, of course, the snap action action switch 116 and the wiring associated therewith as well as the crank arm 118 and the end 139 of thrust rod 125 actuates same are also exposed for inspection.

Referring to the rock shaft 132 (see FIGS. 2 and 4), it is of relatively small diameter in the transverse cross-sectional direction for the low deadband reasons that are discussed hereinafter, and further, both the radial arms 134 and 136 are in coplanar relation and also are of equal lengths in construction and application, radially of rock shaft 132. Thus, the arm 136 is formed with spherically contoured head 139 that is of the same size and dimension as the corresponding head 204 of arm 134. The respective arms 134 and 136 are each formed with the respective flanges 270 and 272 that are of hex configuration so that they may be threadedly anchored within their respective mounting holes (not shown) that are formed in rock shaft 132 radially of same. The rock shaft 132 is journaled in bore 274 (of plate 22) that is of round configuration and is coaxial with the swing axis 133. Bore 274 is open to the recess 182 for journaling one end 276 of rock shaft 132 in same. The specific rock shaft 132 illustrated, intermediate the rock shaft arms 134 and 136, is formed with a suitable groove 277 that receives an O-ring seal 278 that is in fluid sealing relation with the bore 274 three hundred sixty degrees thereabout. The rock shaft 132 has hardened stainless steel balls 280 and 281 pressed into the respective ends 276 and 282 of same, with suitable set screw 284 being threadedly mounted in the plate 22 to journal the rock shaft 132 within the plate 22 and between its balls 280 and 281, which thus serve as journaling bearings for the shaft 132 that minimize kinetic friction.

As indicated in FIG. 4, the rock shaft arms 134 and 136 lie in a common plane that includes the rock axis 131 of the shaft 132 and that is approximately perpendicular to the axis 32, depending on the set point of the assembly 10 and the pressure differentials that are to act on diaphragm 34. As the rock shaft 132 is thus coupled to the piston 64, it is not necessary to have a spring to bias the shaft 132 to keep the arm 134 in contact with the piston 64. After the rock shaft 132 has been journaled in its operative position, its arms 134 and 136 may be applied thereto; in the case of the arm 134, this is done before the diaphragm plate 188 is applied thereto using an elongate hex shaped tube to engage the hex shaped flange 270, while in the case of the arm 136, this is done by removing suitable screw 286 from the bore 288 of the plate 22 to expose the internally threaded aperture in which the arm 136 is to be mounted, after which the arm 136 may be applied to the same turning tool used for arm 134 and secured in the position indicated in FIG. 2 (arm 136 being formed with hex shaped flange for this purpose) wherein the arms 134 and 136 are applied to rock shaft 132 are of equal lengths and are in coplanar relation.

The apparatus 10 as offered for sale will not include the wiring arrangement that is diagrammatically illustrated in FIG. 1, but will include the snap action switch 116, the bell crank lever 118 that actuates same, and the mounting frame 120, as well as the remaining components of the body 14 that have been described in detail, which will be fully assembled for application of the assembly 10 to serve the needs of the designer in one or more situations of the general type outlined hereinafter. The necessary wiring, etc. can be supplied depending on the conventional needs involved in the application to which the assembly 10 is to be put.

As has been brought out heretofore, a principal object of the invention is to transmit the diaphragm motion due to the differential pressures sensed by the assembly 10 through a high pressure seal to a snap action switch 116 while minimizing friction of operation (too much of which would cause high deadband), and without causing a change of set point with a change in total pressure (in devices of the type disclosed, a set point of 5 psig. should be maintained regardless of whether the total pressure involved is 10 psi or 1,000 psi).

In the disclosed assembly 10, it will be observed that the assembly 10 is to actuate a rotary "take-out" shaft 132, with the combination involved including an adjustable range spring arrangement in which the range spring 82 that is employed to adjust the set point of the assembly 10 is in at least one of the pressure chambers of the assembly. The rotary "take-out" arrangement of this device permits the transmission only of the torque that is needed to actuate the snap-action switch 116. Having the assembly range spring 82 inside one of the pressure chambers of the differential pressure sensing mechanism 13 of the assembly 10 provides frictionless application of the range spring "spring force" directly to the diaphragm 34.

The sizing of the rotary shaft 132 and the components associated therewith provides for a relatively "small" amount of motion to actuate the assembly 10 to its set point, with internal friction at the rock shaft 132 being minimized by the ball bearing journaling of same at the ends thereof, and the relatively small motion that is needed to actuate the assembly 10 insuring a correspondingly small motion at the seal provided by the O-ring seal 278 about the bore 274, which in effect insures the integrity of the low pressure in the composite low pressure chamber at this point. It is believed that the O-ring seal 278 in performing its sealing function does not slide about bore 274, but rather deforms in elastic shear over the small distance involved; this has the effect of eliminating most sliding friction in the seal 278, again contributing to the lower deadband provided by the disclosed assembly 10. Further, since the rock shaft arms 134 and 136 are in coplanar relation and are of the same radial length, the pressures that the shaft 132 experience in the low pressure composite chamber 245 do not cause the shaft 132 to react radially of same, this again minimizing friction of operation. Ball 281 acts as a thrust bearing in the illustrated embodiment, but the indicated thrust acting longitudinally of shaft 132 can be eliminated, if desired, by applying a duplicate of groove 277 and seal 278 to shaft 132 on the other side of bore 182.

The diaphragm 34 may be of any suitable flexible diaphragm type, such as a suitable woven fabric impregnated with a layer of elastomer, but the diaphragm 34 in accordance with the present invention should be preconvoluted (that is, shaped as shown in FIG. 4) to define annular convolution 36. As a preconvoluted diaphragm has an elastic memory (returns to original position), the inherent spring rate involved limits low pressure capabilities. It is preferred that the total thickness of the diaphragm 34 be approximately 0.020 inch. As indicated in FIGS. 4 and 6–8, the O-rings 160 and 210 are oppositely disposed, that is, they are disposed in congruent relation on either side of the diaphragm 34 and in close fitting relation to the diaphragm convolution 36. The annular lands 156 and 206 are similarly in opposed congruent relation so that the diaphragm convolution 36 fits within the recessing 247 of plate 188 radially within the land 206 in the event of overpressure in the high pressure chamber 42 (see FIG. 7), and in the event of overpressure in the reverse direction (see FIG. 7), the diaphragm convolution 36 is supported by land 156 so that the convolution does not turn "inside out".

The assembly piston 64 is arranged so that when the differential pressure experienced by the assembly 10 is below set point (see FIG. 6), the piston 64 will not travel far enough toward the high pressure chamber to press the diaphragm 34 against the high pressure passage 44. This spacing of the diaphragm control portion 70 from passage 44 for normal operation is essential as otherwise the effective area of the diaphragm and the assembly set point would thereby be increased.

As to the range spring adjusting screw arrangement 112 employed in accordance with the invention, the adjustment screw itself rotates but does not travel longitudinally (that is along axis 32), but the nut 92 does travel longitudinally of subchamber 88, and thus longitudinally of axis 32. Further, the range spring adjustment employed permits overtightening or overtorquing in either direction without damage, as has been already described.

The housing 12 and the body 14 are arranged to provide a "explosion proof" drain arrangement that incorporates the passage 300 that parallels the axis 32, the threaded cross passage 302 at the base of same that is shown in FIG. 4, and the threaded drain plug 304 that is shown in FIG. 4. This accommodates inflammable liquids that can pass through the indicated passages by making the threading of the drain plug of a sufficiently loose fitting nature to permit any fluid entering within housing 12 to exit from the assembly 10 while keeping any flame that has occurred inside the housing 12 (should such fluid be inflammable).

It is also preferred that the housing 12 be of a suitable waterproof construction, such as involving O-ring seals applied where indicated at 310 and 312. Preferably, body 16 has an O-ring seal 313 sealingly applied between plates 22 and 26 inwardly of the ring of bolt holes 33, and in a groove 315 formed in plate 26 for that purpose, to seal off rain water and the like from having access to the low pressure composite chamber 245 and associated components.

As the assembly diaphragm 34, when the assembly 10 is mounted in operating position, in effect senses a differential pressure that exists between the high pressure and low pressures sources to which the assembly 10 is connected, eventually the resulting differential pressure and consequent unbalanced force generated thereby will exceed the spring force exerted by the range spring 82; and consequently the diaphragm 34, and in particular its midportion 70, will rise. As the rolling type of diaphragm 34 that is employed tends to maintain the central area 70 thereof to have a constant area during the full stroke to be experienced by the assembly 10, the forces generated to effect operation of the snap action switch are independent of absolute values, and are solely proportioned to the difference in the pressures on the high and low pressure cavities. The arrangement involved in moving the sensing mechanism to its set point position preferably has a maximum diaphragm travel that is less than the diaphragm thickness. As the approximate deadband travel of the snap action switch 116 is 0.003 inch, by coupling or trapping the arm 134 of the rock shaft 132 within the piston, as disclosed, and with less than 0.002 inch clearance, the deadband resulting from the travel of the range spring through compression and extension thereof is limited, and nearly all of the deadband involved is a function of the friction between the rock shaft O-ring seal 278 and shaft 132.

It should also be noted that the preconvoluted diaphragm 34 employed allows for friction free travel as the diaphragm convolution rolls in response to pressure changes, instead of stretching or sliding. This is also true for the two overpressure positions shown in FIGS. 7 and 8.

The assembly 10 is to have a minimum actuation/-deaction travel, such as in the range of from approximately 0.003 inch to approximately 0.005 inch, inherent to the general arrangement involved, which reduces the deadband resulting from the combination of the range spring and diaphragm memory spring rates. Thus, most of the deadband results from the friction between shaft 132 and its O-ring seal 278. It is believed that physical movement at the surface of O-ring 278 approximates only 0.001 inch tangentially thereof during actuation/-deactuation travel. The balls 280 and 281 are of 1/16th inch diameter to minimize friction at higher static pressures.

The assembly 10 has substantial high overpressure capabilities. Thus, the diaphragm 34 will "seat" if overpressurized in either direction, as has been discussed and illustrated in FIGS. 7 and 8. nn the overpressure condition represented by FIG. 7, the diaphragm convolution 36 seats against the piston head 66, and the floor 325 of counterbore 247, while in the opposite overpressure condition illustrated in FIG. 8, the diaphragm 34 fully seats against the floor 327 of pressure cavity 42 without extruding into passage 44. As has also been brought out, it is important that the diaphragm 34 not extrude into and through the high pressure bore 44 during such reverse overpressure conditions, and for this purpose the pressure sensing components and the assembly 10 are arranged so that passage 44 is of relatively small nature, having a diameter of 0.0135 inch in a successful embodiment. Further, the cooperation between the piston 64 and the insert plate 188 provides for a built in stop on reverse travel to insure that the portion 70 of diaphragm 34 remains suspended at pressures below the assembly set point, and for overpressure conditions on the high pressure side of assembly 10 (see FIG. 7).

In the case of O-ring seal failure in connection with O-ring seal 278, which might allow flammable fluid to have access to the space enclosed by housing 12, the drain of plate 26 and the drain plug 304 associated with same allows possibly inflammable fluid to drain from the assembly 10 before reaching the electrical switch 116. The same relief valve-drain arrangement also insures that absolute pressures will not build up in the cavity defined by housing 12.

There are a number of applications for the assembly 10 that are important to keep in mind.

For instance, a typical filter might be designed for a working pressure of 1,000 psig., and when the filter is clean, the differential pressure across the filter might be in the range of 2 to 3 psig.; after dirt has accumulated in the filter, the differential pressure might increase to approximately 7 to 8 psig. The differential pressure switch assembly of the present invention can be used to sense the increased differential pressure across the filter, with the snap action switch involved being connected to actuate, for instance, an alarm or other device for alerting a maintenance crew.

Another application invovles a typical method for measuring fluid flow (gas or liquid) wherein the use of an orifice plate and a differential pressure sensor are employed. The differential pressure across the orifice plate orifice is proportional to the fluid flow therethrough (the square of the flow actually); thus, a differential pressure switch assembly 10 may be substituted for other types of flow switches to monitor the flow rate involved.

Also, where the sensing of the level of a liquid in a tank is concerned, the pressure at the bottom of the tank is equal to the sum of the pressure due to the height of the liquid plus the gas pressure above the liquid. In a typical application involving the present invention, the assembly 10 could be used to indicate high or low liquid level by measuring the differential pressure between the top and the bottom of the tank, and actuate an electric motor driven pump when the level gets too low.

Insofar as the pumping of fluid is concerned, an operating pump of this type develops a differential pressure between its inlet and outlet. If the pump stops operating the differential pressure involved usually drops to zero. A differential pressure switch assembly 10 might be used to sense pump failure and activate a suitable alarm to solve the problem.

As to fluid flow sensing in general, whenever a fluid (a gas or liquid) flows, differential pressures develop across obstructions to the fluid stream. Such differential pressures can be used to operate differential pressure switch assemblies to indicate by way of signal predetermined high or low flow rates. For example, an induction heater may have cooling fluid flowing across the coil; a differential pressure switch assembly 10 could be employed to sense the reduction or loss of fluid flow through the coil, by sensing the differential pressure across the coil and activating a suitable alarm when the flow rate got too low. As another example, a differential pressure switch assembly could be employed to indicate fluid flow through a water chiller by sensing the differential pressures across the chiller and activating a suitable alarm when the flow became too low.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a differential pressure switch having a pressure cavity in which is mounted a flexible diaphragm separating and low pressure chambers, and in which motion of the diaphragm due to increases in the differential between fluid pressures in the respective chambers is to actuate a snap action switch mechanism located exteriorly of the chambers, said switch comprising:

a first body member defining the high pressure chamber and means for connecting a high pressure fluid source thereto, second body member formed to define a recess opposing the high pressure chamber, with the high pressure chamber and said recess being in congruent relation and having congruent marginal walls that are seated against the diaphragm, and with the high pressure chamber and said recess being centered on a first axis that extends normally of said diaphragm, a piston mounted in said second body member and extending through said recess in substantially centered relation with said axis and having one end of same engaging the diaphragm, a range spring seated on the other end of said piston for adjustably biasing said piston for movement along said axis toward the high pressure chamber, said piston being guided for movement longitudinally of said axis, a third body member anchored to said second body member defining a subchamber in which said range spring is received, said second body member being recessed about said piston to define a void space thereabout, said second body member and said third body member having recesses defining a composite low pressure chamber, said second body member having means for connecting the source of low pressure to same and said composite low pressure chamber, a rock shaft journaled in said second body member for rocking movement about a rocking axis that lies in a plane that is normally oriented relative to said first axis and said piston, said rock shaft having a first radial arm coupled to said piston for movement therewith and exposed to said composite low pressure chamber, said rock shaft having a second radial arm spaced longitudinally of said shaft from said first radial arm, means for sealing said second radial arm from said low pressure composite chamber, and mechanical means interposed between said second radial arm and the snap action switch mechanism for actuating the switch mechanism when the differential pressure of said chambers reaches a predetermined amount.

2. The differential pressure switch set forth in claim 1, including, a thrust bearing journaling said rock shaft at the end of same that is closest to said second radial arm.

3. The differential pressure switch set forth in claim 1, wherein:

the coupling of said rock shaft first radial arm is a direct action coupling.

4. The differential pressure switch set forth in claim 1, including:

means for stopping said piston from movement beyond predetermined positions in either direction longitudinally of said first axis in the event of overpressures acting on the respective sides of said diaphragm.

5. The differential pressure switch set forth in claim 1, including:

means for permitting without damage over and under compression of said range spring in adjusting the bias of same on said piston.

6. The differential pressure switch set forth in claim 1, wherein:

one of said body members includes an explosion proof drain arrangement including a drain passage of small cross dimension that is intersected by a threaded opening having drain plug removably and loosely mounted in same to accommodate draining from said passage.

7. The differential pressure switch set forth in claim 1, wherein:

said radial arms are of equal lengths and are in coplanar relation.

8. The differential pressure switch set forth in claim 1, wherein:

said first and second body members are each formed with an annular groove centered about said first axis, with said grooves being coaxially and congruently oriented for defining oppositely facing lands of annular, coaxial and congruent orientation which seat against the diaphragm, and including an O-ring seal sealingly mounted in each of said annular grooves and in sealing relation to said diaphragm on either side thereof.

9. The differential pressure switch set forth in claim 1 wherein:

said range spring is of the helical type, and is disposed in a housing having a range spring chamber including a portion of non-circular configuration through which said range spring extends, and screw and nut means for setting said range spring to provide a desired set point for actuation of the snap action switch including a nut of non-circular configuration received in close fitting sliding relation with and within said chamber portion, and threadedly received on a screw shank having a head that projects exteriorly of said housing and is shaped for rotating same for adjusting said range spring to vary the set point of the switch.

10. In a differential pressure switch having a pressure cavity in which is mounted a flexible diaphragm separating high and low pressure chambers, and in which motion of the diaphragm due to increases in the differential between fluid pressures in the respective chambers is to actuate a snap action switch mechanism located exteriorly of the chambers, said switch comprising:

a first rigid member defining the high pressure chamber and means for connecting a high pressure fluid source thereto, a second rigid member fixedly mounting a diaphragm plate defining a recess opposing the high pressure chamber, with the high pressure chamber and said recess being in congruent relation and having congruent marginal walls that are seated against the diaphragm, and with the high pressure chamber and said recess being centered on a first axis that extends normally of said diaphragm, a piston mounted in said second rigid member in substantially centered relation with said axis and having one end of same engaging the diaphragm through said diaphragm plate, a range spring seated on the other end of said piston for adjustably biasing said piston for movement along said axis toward the high pressure chamber, said piston being guided for movement longitudinally of said axis, a third rigid member anchored to said second rigid member defining a subchamber in which said range spring is received, said second rigid member being recessed about said piston to define a void space thereabout, said second rigid member and said third member recessing defining a composite low pressure chamber, said second rigid member having means for connecting the source of low pressure to same and said composite low pressure chamber, a rock shaft journaled in said second rigid member for rocking movement about a rocking axis that lies in a plane that is normally oriented relative to said first axis and said piston, said rock shaft having a first radial arm coupled to said piston for movement therewith and exposed to said composite low pressure chamber, said rock shaft having a second radial arm spaced longitudinally of said shaft from said first radial arm, means for sealing said second radial arm from said low pressure composite chamber, and mechanical means interposed between said second radial arm and the snap action switch mechanism for actuating the switch mechanism when the differential pressure of said chambers reaches a predetermined amount.

11. The differential pressure switch set forth in claim 10, wherein:

said first rigid member is indented away from the diaphragm to define a portion of said high pressure chamber, said diaphragm plate being indented away from the diaphragm to define said recess thereof, said indentations of said first rigid member and said diaphragm plate being in coaxial and congruent relation.

12. The differential pressure switch set forth in claim 11, wherein:

said first rigid member and said diaphragm plate are each formed with an annular groove about their respective indentations, with said grooves being coaxially and congruently oriented for defining oppositely facing lands of annular, coaxial and congruent orientation which seat against the diaphragm.

13. The differential pressure switch set forth in claim 12, including:

an O-ring seal sealingly mounted in each of said annular grooves and in sealing relation to said diaphragm on either side thereof.

14. The differential pressure switch set forth in claim 10, including:

a fourth rigid member received about said third rigid member and being apertured for close fitting relation to said third rigid member, said third rigid member adjacent said second rigid member defining a flange about same, and said fourth rigid member being seated against said third rigid member flange, means for adjustably securing said fourth rigid member to said first rigid member to anchor said third rigid member to said second rigid member, and means for effecting a fluid seal between said fourth member flange and said second member about said first axis.

15. The differential pressure switch set forth in claim 14, wherein:

said range spring is of the helical type, said third rigid member recess having a portion of non-circular configuration through which said range spring extends, and screw and nut means for setting said range spring to provide a desired set point for actuation of the snap action switch including a nut of non-circular configuration received in close fitting sliding relation with and within said third rigid member recess, and threadedly received on a screw shank having a head that projects exteriorly of said third rigid member and is shaped for rotating same for adjusting said range spring to vary the set point of the switch.

16. In a differential pressure switch assembly having an internal pressure cavity across which is mounted a flexible diaphragm separating high and low pressure chambers, and having a snap action switch mechanism mounted externally of the pressure cavity in which motion of the diaphragm due to increases in the differential between fluid pressures in the respective chambers is to actuate the snap action switch mechanism, said switch assembly comprising:

a composite body defining the switch pressure cavity, with the snap action switch mechanism being mounted externally of said body, said body comprising:

a first rigid member defining the high pressure chamber and means for connecting a high pressure fluid source thereto, a second rigid member defining a segment of the low pressure chamber and anchored to said first member, with the high pressure chamber and the low pressure chamber segment being in congruent relation and separated only by the diaphragm and having congruent marginal walls that are seated against the diaphragm, with the high pressure chamber and the low pressure chamber segment being centered on a first axis that extends normally of said diaphragm, and with the diaphragm being sandwiched between said first and second rigid members, a piston mounted in said second rigid member in substantially centered relation with said axis and having opposed ends, one of which engages the diaphragm, a range spring seated on the other end of said piston for adjustably biasing said piston for movement along said axis toward the high pressure chamber and into engagement with said diaphragm, said piston being guided for movement longitudinally of said axis, a third rigid member anchored to said second rigid member and being substantially centered on said axis, said third rigid member defining a recess to receive said range spring therein, in which recess said range spring is received, said second rigid member being recessed about said piston to define a void space thereabout intermediate said ends thereof, said second rigid member and said third member recessing defining together with said low pressure chamber segment a composite low pressure chamber within said body, said second rigid member having means for connecting the source of low pressure to same and said composite low pressure chamber, a rock shaft journaled in said second rigid member for rocking movement about a rocking axis that is spaced to one side of said first axis and is in a plane that is oriented relative to said first axis and said piston to be substantially normally thereof, said rock shaft having a first radial arm coupled to said piston for movement therewith and exposed to said composite low pressure chamber, said rock shaft having a second radial arm spaced longitudinally of said shaft from said first radial arm, means for sealing said second radial arm from said low pressure composite chamber, means for sealing said third member recess against fluid under pressure in said composite chamber, and mechanical means interposed between said second radial arm and the snap action switch mechanism for actuating the switch mechanism when the differential pressure of said chambers reaches a predetermined amount.

17. The differential pressure switch set forth in claim 16, wherein:

said radial arms of said rock shaft are in coplanar relation and are of equal lengths radially of said rock shaft.

18. The differential pressure switch set forth in claim 16, wherein:

said rock shaft has a diameter that is less than 0.2 inch, with said means for sealing said rock shaft second radial arm from said low pressure composite chamber comprising a sealing O-ring mounted on said rock shaft in sealing relation to said rock shaft and said second rigid member about said rock shaft and intermediate said arms thereof.

19. The differential pressure switch set forth in claim 16, wherein:

said body includes a drain passage of small proportions crosswise thereof between the space enclosed by said housing and the external surfacing of said body, said drain passage at said external surfacing threadedly receiving a drain plug, said drain passage and said drain plug comprising an explosion proof drain arrangement for said switch.

20. The differential pressure switch set forth in claim 16, wherein:

the diaphragm is pre-convoluted to define an annular convolution that is proportioned to be in rolling relation in overpressure relation toward said low pressure chamber segment, and in overpressure relation toward said high pressure chamber.

21. In a differential pressure switch having a pressure cavity in which is mounted a flexible diaphragm separating high and low pressure chambers, and in which motion of the diaphragm due to increases in the differential between fluid pressure in the respective chambers is to actuate a switch mechanism located exteriorly of the chamber, said switch comprising;

a first body segment defining the high pressure chamber and means for connecting a high pressure fluid source thereto, second body segment formed to define a recess opposing the high pressure chamber, with the high pressure chamber and said recess being in congruent relation and having congruent marginal walls that are seated against the diaphragm, and with the high pressure chamber and said recess being centered on a first axis that extends normally of said diaphragm, a piston mounted in said second body segment and extending through said recess in substantially centered relation with said axis and having one end of same engaging the diaphragm, a range spring seated on the other end of said piston for adjustably biasing said piston for movement along said axis toward the high pressure chamber, said piston being guided for movement longitudinally of said axis, means for defining a subchamber in which said range spring is received, said second body segment being recessed about said piston to define a void space thereabout, said second body segment and said defining means together defining a composite low pressure chamber, said second body segment having means for connecting the source of low pressure to same and said composite low pressure chamber, a rock shaft journaled in said second body segment for rocking movement about a rocking axis that lies in a plane that is normally oriented relative to said first axis and said piston, said rock shaft having a first radial arm coupled to said piston for movement therewith and exposed to said composite low pressure chamber, said rock shaft having a second radial arm spaced longitudinally of said shaft from said first radial arm, means for sealing said second radial arm from said low pressure composite chamber, and mechanical means interposed between said second radial arm and the switch mechanism for actuating the switch mechanism when the differential pressure of said chambers reaches a predetermined amount.

22. The differential pressure switch set forth in claim 21, including a thrust bearing journaling said rock shaft at the end of same that is closest to said second radial arm.

23. The differential pressure switch set forth in claim 21, wherein:

the coupling of said rock shaft first radial arm is a direct action coupling.

24. The differential pressure switch set forth in claim 21, including:

means for stopping said piston from movement beyond predetermined positions in either direction longitudinally of said first axis in the event of overpressures acting on the respective sides of said diaphragm.

25. The differential pressure switch set forth in claim 21, including:

means for permitting without damage over and under compression of said range spring in adjusting the bias of same on said piston.

26. The differential pressure switch set forth in claim 21, wherein:

one of said body segments includes an explosion proof drain arrangement including a drain passage of small cross dimension that is intersected by a threaded opening having a drain plug removably and loosely mounted in same to accommodate draining from said passage.

27. The differential switch set forth in claim 21, wherein:

said radial arms are of equal lengths and are in coplanar relation.

28. The differential pressure switch set forth in claim 21, wherein:

said first and second body segments are each formed with an annular groove centered about said first axis, with said grooves being coaxially and congruently oriented for defining oppositely facing lands of annular coaxial and congruent orientation which seat against the diaphragm, and including an O-ring seal sealingly mounted in each of said annular grooves and in sealing relation to said diaphragm on either side thereof.

29. The differential pressure switch set forth in claim 21, wherein:

said range spring is of the helical type, and is disposed in a housing having a range spring chamber including a portion of non-circular configuration through which said range spring extends, and screw and nut means for setting said range spring to provide a desired set point for actuation of the switch mechanism including a nut of noncircular configuration received in close fitting sliding relation with and within said chamber portion, and threadedly received on a screw shank having a head that projects exteriorly of said housing and is shaped for rotating same for adjusting said range spring to vary the set point of the switch.

* * * * *